United States Patent [19]

Petrus

[11] 4,068,511

[45] Jan. 17, 1978

[54] METHOD AND APPARATUS FOR BAR TEMPERATURE DETERMINATION IN A HOT STRIP MILL

[75] Inventor: George P. Petrus, Roanoke, Va.

[73] Assignee: General Electric Company, Salem, Va.

[21] Appl. No.: 777,618

[22] Filed: Mar. 15, 1977

[51] Int. Cl.[2] ..... B21B 37/10

[52] U.S. Cl. ..... 72/13

[58] Field of Search ..... 72/13, 6–12, 72/31

[56] References Cited

U.S. PATENT DOCUMENTS 3,332,263 7/1967 Beadle et al. ..... 72/7

3,628,358 12/1971 Fapiano ..... 72/8

*Primary Examiner*—Milton S. Mehr

*Attorney, Agent, or Firm*—Arnold E. Renner; Philip L. Schlamp

[57] ABSTRACT

In a continuous hot strip mill comprising a roughing mill, a finishing mill and an intermediate delay table including a coiler, a method and apparatus are provided for determining the temperature of a hot metal bar entering the finishing mill based upon the temperature of the bar leaving the roughing mill. Taken into account are the times spent on the open portion of the delay table and in the coiler and the differences in heat loss by the bar in these two conditions.

14 Claims, 7 Drawing Figures

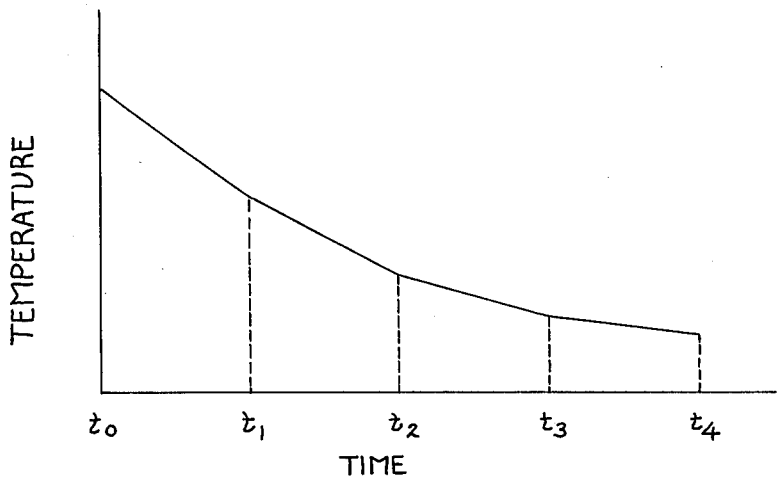
FIG. 3
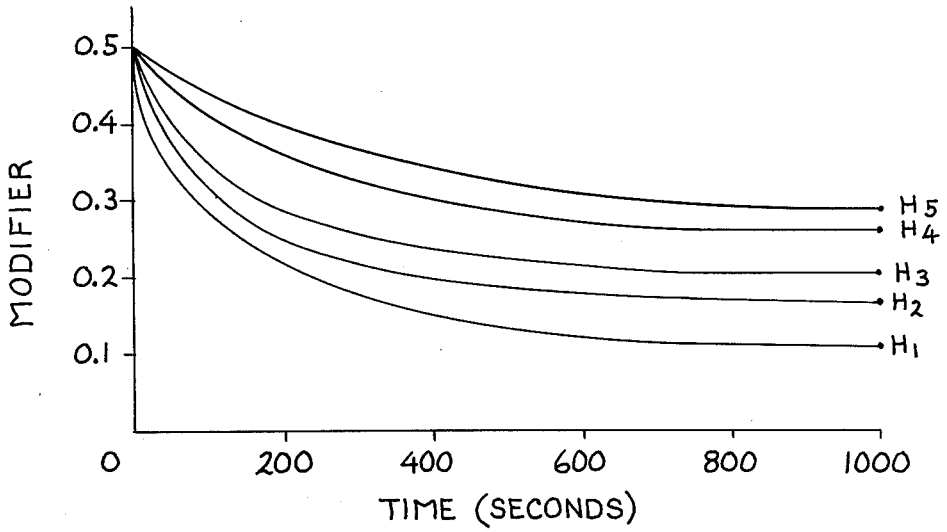
FIG. 4
THICKNESS
| TIME (SECONDS) | $H_1$ 0 MM | $H_2$ 20 MM | $H_3$ 25 MM | $H_4$ 35 MM | $H_5$ 100 MM |
|---|---|---|---|---|---|
| 0 | .50 | .50 | .50 | .50 | .50 |
| 50 | .31 | .37 | .39 | .44 | .46 |
| 100 | .26 | .30 | .34 | .39 | .43 |
| 200 | .21 | .23 | .27 | .33 | .36 |
| 1000 | .11 | .16 | .20 | .26 | .29 |
FIG. 5

METHOD AND APPARATUS FOR BAR TEMPERATURE DETERMINATION IN A HOT STRIP MILL

BACKGROUND OF THE INVENTION

The present invention relates generally to the rolling of hot metal workpieces and more particularly to the determination of the workpiece temperature as it enters the first stand of a finishing mill.

In order to roll quality on-gage metal sheets and bars, a number of properties of the metal (e.g., steel) to be rolled should be accurately known. Primary among these properties, in the case of a hot rolling mill, are the material's composition, its thickness, its width and its temperature as it enters the finishing mill. The composition of the material is normally known before any rolling operation begins. Width and thickness are physical parameters which are fairly easily determined by various methods including physical measurements at any of several places in the mill. Temperature presents a more difficult problem in that pyrometers generally in use today are capable of providing accurate measurements only when the bar's surface is relatively clean and devoid of the scale which forms when the heated material is exposed to air. Other methods of temperature determination, in today's technology, are generally no more accurate than well tuned pyrometers in determining bar temperature.

The most common method of rolling hot metal strip involves heating an ingot or slab to a fairly high temperature (e.g., 1300° C) and then reducing the thickness of the bar by subsequent passing of the slab through a series of rolling mill stands. The rolling sequence normally takes place in two stages commonly referred to as the roughing mill and the finishing mill. The roughing mill may be either of the tandem type or a reversing mill employing a single stand. In either case the slab or ingot is subjected to repeated operations in the mill until its thickness is reduced to some prescribed value, normally in the range of 1 to 10 centimeters, at which time it leaves the roughing mill and is transferred by way of a delay table to the finishing mill. The finishing mill is usually of the tandem type wherein the bar, as it is now customarily called, is further reduced in thickness to sheet of the desired thickness or gage. It is in the finishing mill where the previously mentioned parameters of composition, width, thickness and temperature become very important to the accurate rolling of on-gage material in order to "set up" the mill to achieve the proper rolling. As an example of a method by which a finishing mill is set up, reference is made to U.S. Pat. No. 26,996, "Computer Control System For Metals Rolling Mill" by R. G. Beadle et al (issued Dec. 8, 1970) which patent is assigned to the assignee of the present invention.

As previously mentioned, pyrometers in general use today normally need a clean surface in order to accurately determine temperature. Because a hot bar develops surface scale fairly rapidly when exposed to air, it is proven impractical to provide a direct measurement of the bar temperature as it enters the finishing mill. Standard practice, therefore, in the past has been to measure the temperature of the head end of the bar as it exits the roughing mill where it is relatively free of scale. The length of time the bar remains on the delay table is then measured and using well-known heat transfer equation, the temperature of the bar as it enters the finishing mill is determined. This method has proven quite satisfactory for standard mills.

There are, however, a number of other problems associated with such standard mills, particularly in association with the delay table. For example, such a delay table must be longer than the actual length of the bar as it emerges from the roughing mill. This, of course, affects the size of the physical plant required. In addition, because the bar exit speed is must higher than the finishing mill entry speed (e.g., 4 times as high), the tail end of the bar will normally remain on the table for a longer period of time with a resultant greater loss of heat. As such, the tail of the bar enters the finishing mill at a lower temperature than the head thus requiring compensation during rolling within the finishing mill.

The length of time that a bar spends on the delay table is also related to the amount of scale which is developed on the bar which in turn determines the amount of descaling required before the bar enters into the finishing mill. As a method of descaling, high pressure water sprays are often used and it is readily seen that the greater amount of scaling which occurs, the greater amount of descaling and hence a greater amount of heat loss due thereto.

In an effort to minimize the above problems, a system utilizing a coiler as a part of the delay table has been devised. This system is described in detail in U.S. Pat. Nos. 3,803,891. "Method Of Rolling Hot Metal Workpieces" by W. Smith (issued Apr. 16, 1974) and 3,805,570, "Method And Apparatus For Rolling Hot Metal Workpieces And Coilers For Use In Coiling Hot Metal Workpieces" by W. Smith (issued Apr. 23, 1974), which patents are specifically incorporated hereinto by reference.

The rolling method involving the use of a coiler, while alleviating some of the aforementioned problems, creates others. In this system, the head end from the roughing mill is first into the coiler but the tail end is the first to emerge therefrom. Thus, the tail end from the roughing mill becomes the head end to the finishing mill. Due to the fact that there still exists a difference in temperature between head and tail ends, the temperature measurements and calculations made in the old manner are unsatisfactory. In addition, the heat dissipation from the bar in coil from while in the coiler is considerably different from that experienced when the bar is flat on the open portion of the delay table. Thus, it is seen that the existing method of calculating the finishing mill entry temperature is not satisfactory for this type of mill.

SUMMARY OF THE INVENTION

It is, therefore, an object of the present invention to provide an improved method and apparatus for determining the temperature of a hot metal bar entering a stand of a rolling mill.

It is a further object to provide a method for calculating the temperature of a hot metal bar entering the stand of a rolling mill based upon measurements made as the bar exists a previous stand of the mill.

It is a still further object to provide a method and apparatus to determine the temperature of a hot metal bar as it enters a rolling mill after being delivered to a coiler from a previous rolling operation.

It is another object to provide apparatus and method of determining the temperature of a hot metal bar as delivered to the first stand of a finishing mill in a system employing a coiler as a part of the delay table of the system.

Still another object is to provide for the determination of the temperature of the hot metal bar as it enters a finishing mill from a roughing mill by way of a delay table including coiling means.

The foregoing and other objects are achieved in accordance with the present invention by providing, in a metal rolling system having a first section (e.g., roughing mill), a second section (e.g., a finishing mill) and an intermediate delay table including a coiler, the determination of the temperature of the trailing end of the metal bar as it leaves the roughing mill and to further determine the temperature drop occurring for transient times between the roughing mill and the coiler. A second calculation for the temperature drop while the bar is in the coiler is then made and, if necessary, a third calculation of temperature drop for the transport time from the coiler to the finishing mill is also made. The finishing mill entry temperature is then determined by combining the roughing mill exit temperature with the several temperature drops.

BRIEF DESCRIPTION OF THE DRAWING

While the present invention is described in particularity in the claims annexed to and forming a part of this specification, a better understanding of the invention can be had by reference to the following description taken in conjunction with the accompanying drawing in which:

FIG. 3 is a graph useful in understanding the basic temperature calculation in both the prior art and the present invention;

FIG. 4 is a series of curves defining the relative heat loss of bars of varying thicknesses in the coiler as compared to a bar on the open portion of a delay table;

FIG. 5 is a table of values such as might be stored in a computer memory for determining the relationship shown graphically in FIG. 4;

DETAILED DESCRIPTION

Figure 1:
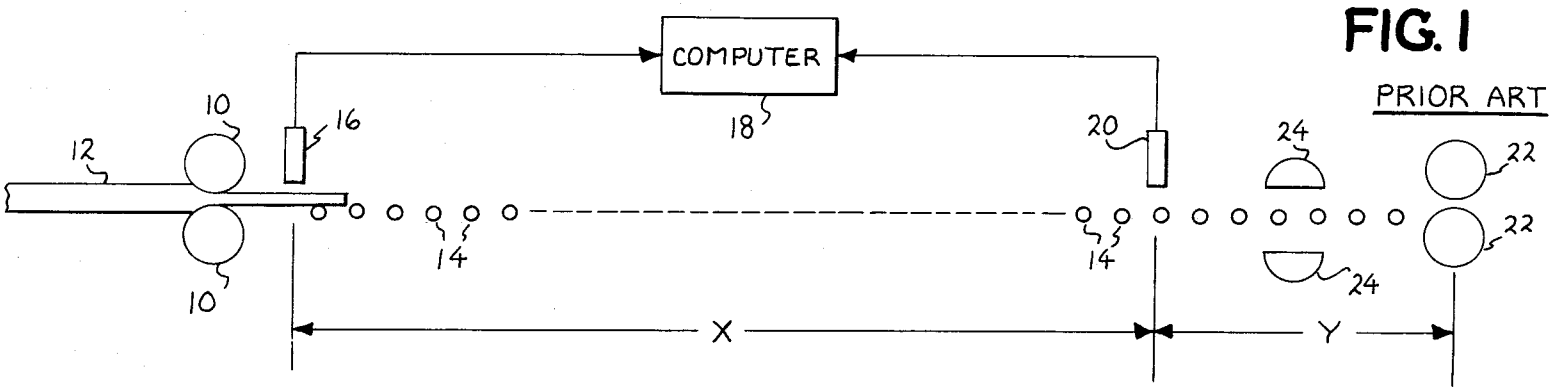
FIG. 1 PRIOR ART
FIG. 1 is a schematic drawing of a conventional continuous hot strip mill in accordance with prior art.

Before beginning a description of the present invention, it is believed advantageous to describe briefly the prior art type continuous rolling mills and the calculation of finishing mill entry temperature with respect thereto. The basic or "conventional" rolling mill which is in widespread use today is shown in FIG. 1. Referencing now that figure, there is schematically shown a pair of rolls 10 which represent the last rolls or the final stand of a roughing mill. As previously indicated, the rolls 10 may be the last stand of a tandem roughing mill or the single stand of a reversing roughing mill, In either case, the output from the rolls 10 is a bar of material 12 delivered onto a delay table indicated by a plurality of rollers 14. The thickness of the bar 12 as it exits the rolls 10 may be determined in any of the conventional manners such as the use of an X-ray gage (not shown) or by some other known method such as a calculation involving the setting of the rolls 10; i.e., their opening, and the forces exerted by the bar 12 on the rolls 10 as the material is being rolled. Located adjacent the rolls 10 is a pyrometer 16 which in this system performs two functions. Pyrometer 16 serves first to determine the time of bar exit from the roughing mill and second to sense the temperature of the bar which, at this time, is relatively free of scale due to the rolling operation just performed. Normally, approximately five or six readings, spaced apart in time, will be taken so than an average of the temperature of the first few feet of the head end of the bar 12 may be determined. The signals generated by the pyrometer 16 are supplied to a computer 18 which may be of any of those well known in the art of the general purpose category, for example, a Honeywell 4400 computer.

As the bar leaves the roughing mill, it is transported across the delay table. At some distance from the roughing mill, there is located a second sensing means 20 which serves to determine the presence of the head end of the bar at that point. Detector 20 may be another pyrometer or it may be some other means to sense presence. As shown in FIG. 1, the distance between the two presence sensing devices 16 and 20 is designated "X" and it is seen that the computer 18 by comparing the time of arrival of the signals from the pyrometer 16 and the device 20 may determine the time required for the transportation of the bar 12 from the rollers 10 of the roughing mill to the sensor 20. It is noted that this time may vary over a fairly wide range for any number of reasons; e.g., a malfunction in the finishing mill, and that the bar may be held on the delay table for a period of time. For purposes of completeness, located further away from the roughing mill rolls 10 there is shown: (1) a second pair of rolls 22 which represent the first stand of the finishing mill into which the bar will eventually enter, and (2) a pair of descaling sprays 24 located contiguous to the rolls 22 for descaling the metal bar prior to entry into the finishing mill. The sensor 20, because of the requirement for such functions as descaling, is located, as shown in FIG. 1, a distance Y away from the rolls 22. It is recognized that the distance Y will normally be much less than the distance X and, as a matter of practicality, if the sensor 20 can be located sufficiently close to the rolls 22 such that the distance Y is negligible with respect to X then the distance Y may be discounted and only the effect of the sprays need be considered in the temperature calculation as will be discussed hereinafter.

Knowing the time it takes for the bar to transfer from sensor 16 to sensor 20, the heat loss from both sides of the bar can be calculated from the well-known Stefan-Boltzmann equation. This equation states:

$$\text{Heat radiated (both sides)} = 2eS(T_s^4 - T_a^4)$$

wherein:

$e$ = emissivity;

$S$ = Stefan-Boltzmann constant ($4.96 \times 10^{-8}$ K cals./hr./sq. meter/° K$^4$);

$T_s$ = slab temperature in ° K; and, $T_a$ = ambient temperature in ° K.

The emissivity term, $e$, is one which is empirically derived from experience and is a function of a number of things including, primarily, the metal surface and metal surface scale formation. It is also known that the amount of heat contained in a unit of area of the slab is determined by the formula:

$$\text{Heat} = pCHT$$

wherein:

$p$ = density;

$C$ = specific heat of the material;

$H$ = thickness; and $T$ = temperature in ° K.

The two equations above can be combined to derive a radiation coefficient ($R_c$) for a bar which is: $R_c = 2eS/pCH$. This factor when multiplied by a time period ($t$) and by quantity ($T_s^4 - T_a^4$) results in the computation of the temperature drop of the bar for the period of time. Because of the nonlinear nature of the term ($T_s^4 - T_a^4$) it is found that more accurate results can be obtained by summing the results of repetitive calculations for small periods of time than those achieved by a single calculation for the full time that the bar remains on the table; that is, the time it takes the head end of the bar to go from detector 16 to detector 20. In practice, therefore, the total time is divided into segments, for example, segments of 10 seconds each and the drop in bar temperature is calculated for that time segment. By subtracting the thusly determined drop from the last used value of $T_s$, a new $T_s$ value is obtained for a subsequent calculation. FIG. 3 illustrates a plot of bar temperature based upon the iterative type of calculation just described. In FIG. 3, four time segments $t_0 - t_4$ are shown. Assuming $t_0$ to be the time the bar exits the roughing mill, a first calculation for the time period $t_0 - t_1$ is made using the bar temperature ($T_{s0}$) at time $t_0$ to arrive at a new bar temperature ($T_{s1}$) at time $t_1$. Using this newly determined bar temperature ($T_{s1}$), the next calculation for the time period $t_1 - t_2$ is made to derive the $T_{s2}$ temperature. This process continues until the total time the bar remains on the delay table is accounted for and a final bar temperature is determined.

A similar calculation for determining the temperature drop of the bar as it moves over the distance Y can easily be accomplished in that the distance from sensor 20 to the rolls 22 is known and by assuming that the bar maintains the same speed, the time required for the transport for the distance Y is readily calculated in the computer 18 and this time used to calculate an additional drop in temperature of the bar reaching the rolls 22. Of course, if the sprays 24 are used for descaling purposes as is customary, then additional compensation for the temperature drop due to this spraying action would have to be factored into the total temperature drop. This calculation, however, has no bearing upon the present invention and such calculations are well known in the art.

Figure 2:
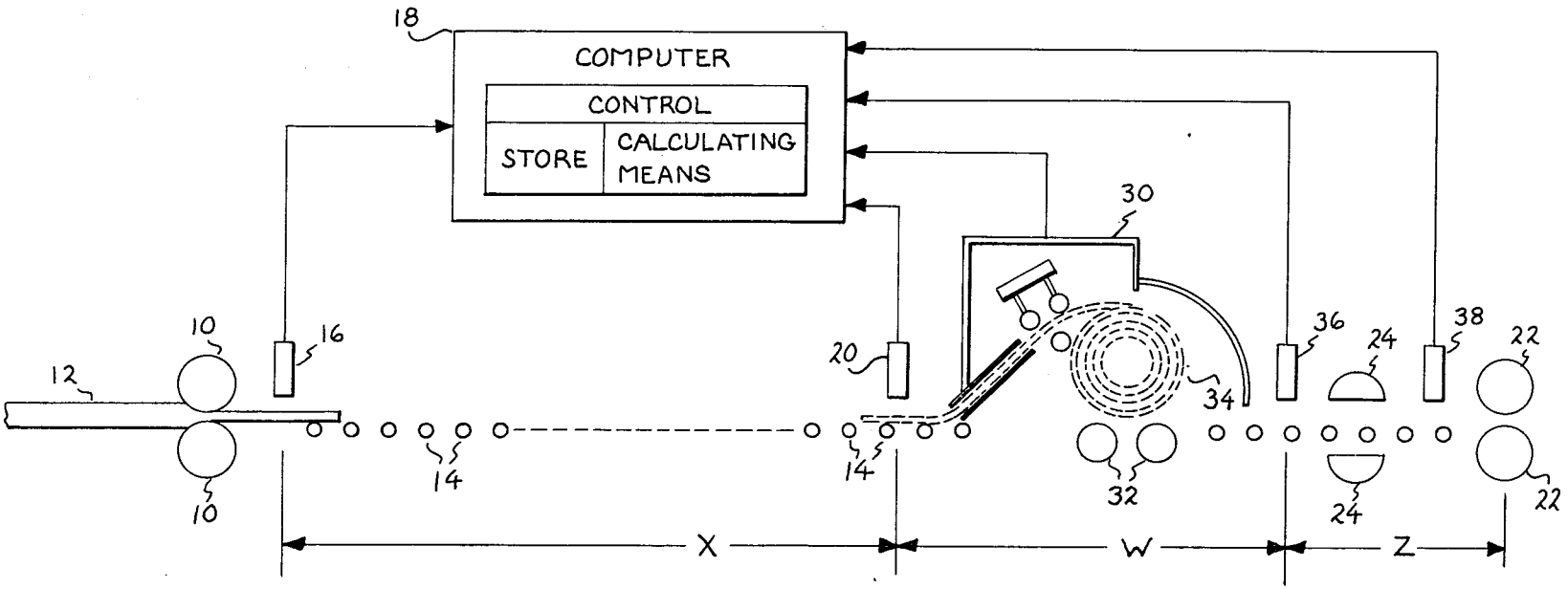
FIG. 2 is a schematic drawing of a continuous hot strip mill employing a coiler in the delay table and to which the present invention is applicable.

Referencing now FIG. 2 there is shown a rolling mill system of the type to which the present invention is particularly applicable. Insofar as similar elements are shown in FIG. 2 as were shown in FIG. 1, the same reference characters will be used. As in FIG. 1, there is again shown a pair of rolls 10 representing the last stand of the roughing mill which is serving to reduce and to feed a bar 13 onto a delay table illustrated, in part, by the rollers 14. Again, a pyrometer 16 is located contiguous to the rolls 10 to serve as a presence detection means and to read the temperature of the bar 12. A second pyrometer or sensing device 20 is located downstream by a distance (X) and, as before, this detector serves only as a presence detector. Signals from the detectors 16 and 20 are fed to the computer 18 which may be the same as used in the FIG. 1 system—a Honeywell 4400 computer. The computer includes, as illustrated in FIG. 2, the basic components of a control section, a store and a calculating means.

At this point, the depiction of FIG. 2 differs from that of FIG. 1 in that there is included a coiler 30 which may be of the type shown in the aforementioned patents, U.S. Pat. Nos. 3,803,891 and 3,805,570. As illustrated by the dashed line 34 in the coiler 30, the type of coiler used is a downcoiler such that the bar coils in the clockwise direction and is supported by a plurality of driven cradle rolls 32. As explained in the aforementioned patents, the downcoiler has the advantage that the tail end of the bar 12 exiting the roughing mill rolls 10 will, when the direction of rotation of the cradle rolls 32 is reversed, be fed from the downcoiler 30 first. That is, the tail end of the bar from the roughing mill becomes the head end entering the finishing mill (rolls 12). Disposed at the exit side of the coiler 30 is an additional sensor 36 which senses the presence of the bar as it emerges from the coiler 30 and there is further provided an additional sensor 38 located adjacent the finishing mill rolls 22. The purpose of the sensors 36 and 38, each of which outputs a signal to the computer 18, is to determine the time required for the bar to transport over the distance between the coiler 30 and the finishing mill rolls 22 (distance Z in FIG. 2). It is, of course, to be realized that other means of determining this time and to determine when the bar exits from the coiler could be used. For example, the time of bar exit from the coiler could be derived from detecting the direction of rotation of the cradle rolls 32 and the time required for transport from the coiler to the finishing rolls 22 could be calculated as a function of a known distance and the existing speed.

The present invention which relates to the determination of the temperature of the bar entering the finishing rolls 22 is as follows. The computation of the temperature drop occasioned by the bar being on the open portion, X, (that portion between the roughing mill and the coiler) of the delay table, is the same as that explained with respect to FIG. 1, with two major exceptions. It will be remembered from the previous discussion that the tail end coming from the roughing mill becomes the head end as it enters into the finishing mill for the reasons stated in the aforementioned U.S. Pat. Nos. 3,803,891 and 3,805,570. Therefore, the temperature which is to be used in the implementation of the present invention is not the head end temperature as was the case in FIG. 1, but is the tail end temperature of the bar as it exits the roughing mill roll 10. Thus, the time of bar presence on the table is also calculated, in the case of FIG. 2, in a slightly different way. In FIG. 1 the first presence of the bar below the sensors was utilized to computate time. In this case that sensed is first the presence of a bar beneath the sensor and then the absence. Sensor 16 must again provide temperature readings but, whereas in FIG. 1 the prescribed number (e.g., five) of first readings was stored and averaged to determine the temperature, in this case the temperature readings desired are those from the tail end of the bar leaving rollers 10. This is achieved by the well-known method of feeding the readings from the pyrometer 16 into a suitable open-ended shift register, which is part of the total store of the computer, such that readings which are first placed into one end of the shift register are shifted sequentially out of the other end and lost. Thus, by taking a series of sequential readings as the bar emerges from rolls 10, the register within the store of the computer will at any one time contain the last readings (any prescribed number; e.g., five) of the bar. When the bar has completely emerged from the roughing mill rolls 10 and passed pyrometer 16, the quantities remaining in the shift register will be those corresponding to the last readings made and these may be averaged and used as the temperature in the calculations.

When the bar enters the coiler 30 an entirely different situation is presented. Because the bar is now in coiled form as opposed to flat form as it was on the open portion of the table, the radiation losses are considerably less. This is due to the fact that only one side of the tail end of the bar will be exposed to air with the other side being adjacent an inner layer of the bar. In addition, as is readily apparent, in the coiled condition heat transfer will be from the inner layers to the outer layers such that the rate of cooling of the bar now assumes an entirely different profile than was true for the bar when it was in its flat, exposed state on the open portion of the delay table.

Through the use of well-known emission formulas, the temperature drop of an outer layer of a heated coil, as a function of time, can be calculated and these results can be transcribed into a set of curves or, alternatively an equation or set of equations, which express the relative emissivity of the coiled form to the open bar form. In the preferred embodiment of the present invention, curves are used and the results of such calculations for a particular material of different thicknesses and times is illustrated in FIG. 4. In FIG. 4, there is plotted on the vertical axis what is here termed a "modifier" and on the horizontal axis, time. It is noted that the modifier never exceeds 0.5, as would be expected, in that in the coil form only one side of the bar is exposed. The five curves labeled, respectively, $H_1$ through $H_5$, represent five different thicknesses of material and it is seen from these curves that the relative rate of heat loss diminishes not only as a function of time but with decreased thickness; that is, $H_5$ is a thicker material than $H_4$. The modifier used is selected from the graphical representation according to the thickness of the material and the total time during which the coil remains in the coiler. (For many reasons the coil could spend a considerable time in the coiler just as before delays of moving the bar from the delay table to the finishing mill could also happen.)

As such, the Stefan-Boltzmann formula previously described with respect to the FIG. 1 showing will be modified by the modifier used as a multiplier such that this equation now takes the general form:

$$\text{Heat radiated (both sides)} = M \cdot 2eS(T_s^4 - T_a^4)$$

wherein, M is the modifier.

In that it is not practical to store curves, as such, in a computer store, the curves are retained in the store portion of computer 18 in the form of tables. FIG. 5 is an example of one such table, and it is to be recognized that a particular table will be valid for only a particular material. Obviously, the greater number of thicknesses and time periods stored, the greater the accuracy of the table. It has, however, been perfectly acceptable to store a reasonable number of values such as illustrated in FIG. 5 and to use interpolation of both time and thickness in accordance with well-known procedures to arrive at the proper figure for the modifier. For example, assuming that the elapsed time was 75 seconds and the actual thickness of the material was halfway between $H_1$ and $H_2$ (i.e., 10 mm), then the modifier by double interpolation would be equal to 0.31.

The alternative method previously mentioned would utilize an equation to derive the modifier. One form of this equation can be expressed as:

$$\text{Modifier} = 0.5 - \frac{A \cdot t}{10^3} - \frac{B \cdot t^2}{10^6} - \frac{C \cdot t^3}{10^9} \ldots$$

wherein:

$$A = A_1H + A_2$$

$$B = B_1H + B_2$$

$$C = C_1H + C_2$$

in which, $A_1$, $A_2$; $B_1$, $B_2$; $C_1$, $C_2$ are constants relating to the metal conductivity to fit the equation to the curve by placement in the general linear form $y = ax + b$.

$t$ = time in seconds $H$ = metal thickness in mm.

Returning to FIG. 2, when the bar exits from the coiler, the original tail end exiting first as previously discussed, sensor 36 will detect its presence and provide a signal to the computer which signal is stored along with a subsequent signal from detector 38 which later senses the presence of the bar. These two signals supplied to the computer will be utlized to compute the time for the bar to progress from the coiler to the finishing mill rolls 22. The calculation for heat loss for this open period of time will be made in the same way as with respect to the "X" distance on the table using, as the bar temperature ($T_s$), the last temperature of the bar when it was in coil form. Therefore, throughout the temperature calculations of the present invention the generalized formula of temperature drop (TD) is:

$$TD = (2eS/pCH) \cdot M \cdot t \cdot (T_s^4 - T_a^4).$$

Thus, the formula remains the same for all calculations in accordance with the present invention and the value of the modifier, M, will change as a function of the bar form (i.e., flat or coiled) and time in the coiled condition. When the bar is on open portions of the table such as distances X or Z, the modifier M is set to 1 and when the calculations are made for the bar within the coiler, the modifier value is determined in accordance with the time and the thickness as described with respect to FIGS. 4 and 5.

Figure 6:
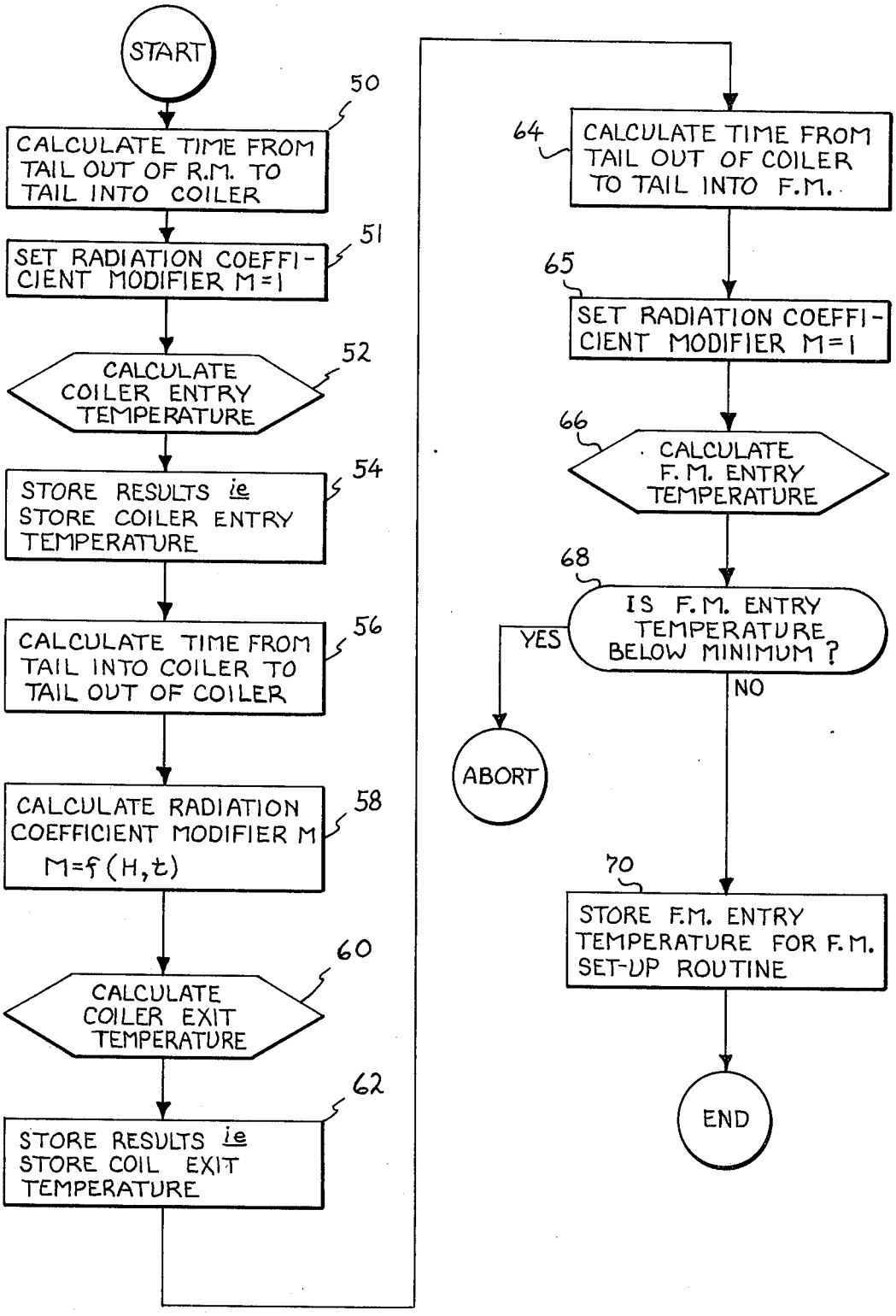
FIG. 6 is a simplified flow chart describing the temperature calculation of the present invention; and, FIG. 7 is a simplified flow chart of a subroutine within the depiction of FIG. 6.
Figure 7:
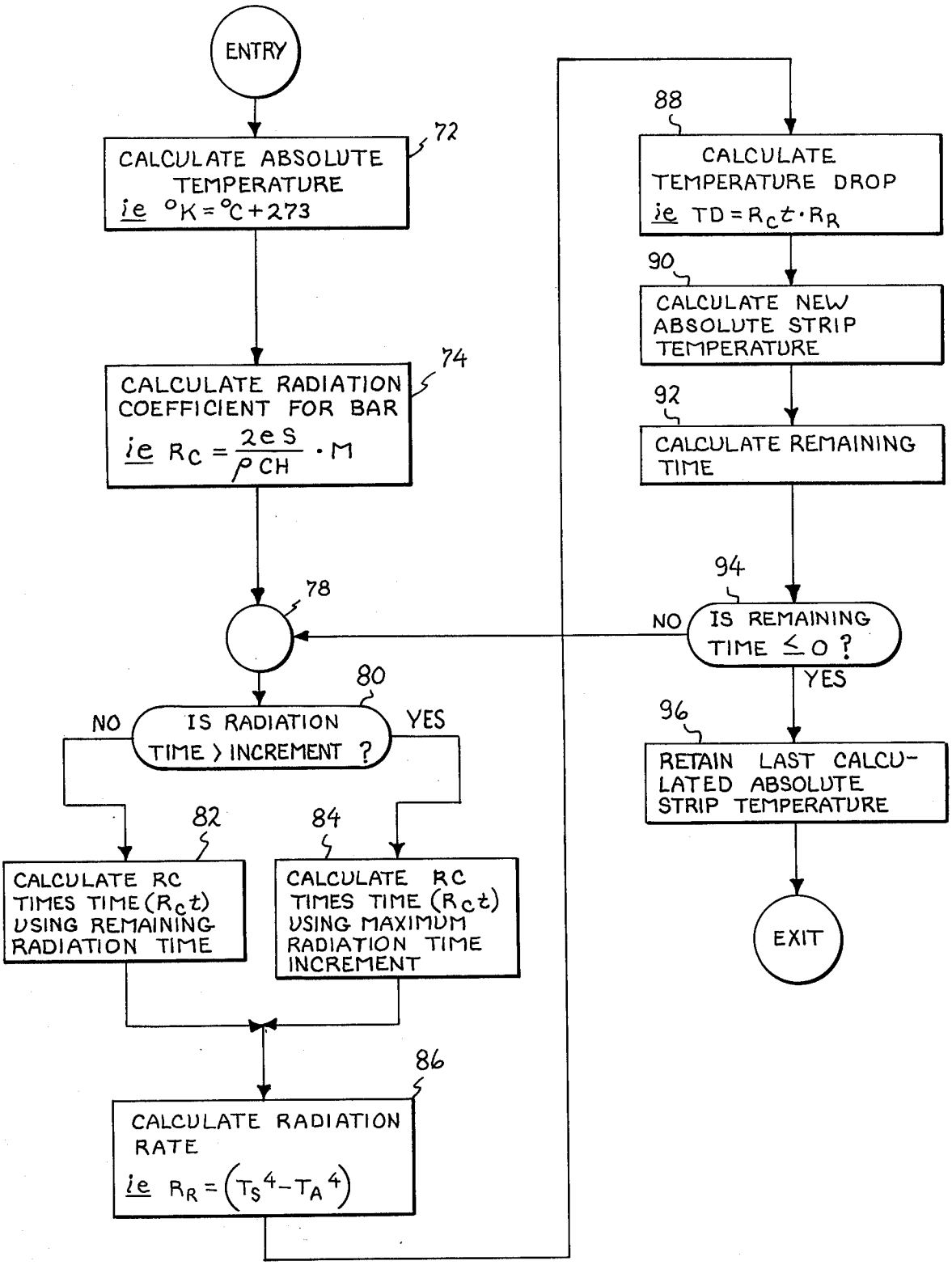

FIGS. 6 and 7 show simplified flow charts describing the operation of the present invention to calculate the entry temperature of the strip to the finishing mill. In these figures, it is assumed that the basic parameters, including the modifier table previously described, such as the emissivity ($e$), the Stefen-Boltzmann constant (S), the density ($p$) and the specific heat (C) of the steel have all been previously stored within the store of the computer as has the thickness (H) which was derived by some suitable means such as an X-ray gage or the determination from the roll openings and force of the roughing mill as previously described. FIG. 6 is the basic routine for determining the overall temperature and FIG. 7 is a subroutine which is entered into several times in the performance of the total routine of FIG. 6.

As is well known in the art, the instruction set for running the program described by FIGS. 6 and 7 will normally be included within the store of the computer 18 and the execution of the program will be under the guidance of the control portion of the computer.

Referencing now FIG. 6, it is seen that upon routine entry the first calculation made (block 50) is for the time elapsed for the tail end of the strip to go from the roughing mill to the coiler. This, as was explained, is achieved using detectors 16 and 20 to sense first the presence and then the absence of material beneath the sensors. In that the bar is now in flat form, the radiation coefficient modifier, M, is set equal to 1 (block 51). With the total time now known and with a temperature value derived from the readings by sensor 16, block 52 is entered wherein the temperature drop of the bar as it passed from the roughing mill to the coiler is calculated and this amount is subtracted from the original sensed temperature to arrive at a new bar temperature ($T_s$). (The subroutine by which this determination is made is shown in FIG. 7 which will be described hereinafter.) As shown in block 54, this temperature is then stored to become the new $T_s$. The next step, as shown in block 56, is to calculate the time the coil remains in the coiler. This time is retained while, in block 58, the radiation coefficient modifier, M, for the bar in coiled form is determined. (The modifier, M, was described with respect to FIGS. 4 and 5 and is a function of the thickness and the time within the coiler.) With the time in the coiler and the modifier known, the subroutine of FIG. 7 (block 60) is again entered and the temperature for the bar as it exits from the coiler is calculated. This temperature, a new $T_s$, is stored (block 62) and the calculation of time for the tail end, now the head end, to go from the coiler to the finishing mill 22 is determined (block 64). Because the bar is once again in flat form, the modifier, M, is set to 1 (block 65) and the subroutine of FIG. 7 is entered for a third time at block 66 to calculate the temperature drop of the bar as it moves the distance Z (FIG. 2). This drop is then subtracted from the temperature of the bar as it leaves the coiler to achieve the temperature of the bar as it enters the finishing mill. Block 68 is a decision block in which it must be decided whether the entry temperature is below a prescribed minimum. This actually plays no part in the present invention and it is included here for purposes of completeness in that the material must have at least a minimum temperature to be rolled in the finishing mill. If the temperature of the bar entering the mill is below that temperature, then the system must be aborted; i.e., the bar pushed off the delay table or other corrective action taken. Assuming that the temperature is not below that minimum, however, then the temperature determined in block 66 is that which is supplied to the computer store as a number to be used in the set up of the mill in accordance with known procedures, for example, that described in the aforementioned U.S. Pat. No. Re. 26,996 by Beadle et al.

From the description of FIG. 6 it was seen that three temperature drop calculations were made and the results of these three calculations were successively substracted from the temperature determined as the bar exited the roughing mill to determine the finishing mill entry temperature. (The effect of temperature drop due to sprays has not been included in this discussion in that it plays no part in the present invention. It is recognized, however, that if descaling sprays are used prior to entry into the finishing mill, the effect of the sprays would most definitely have to be included into the overall system.)

FIG. 7 demonstrates that the same subroutine is used in each of the temperature drop calculations; that is, blocks 52, 60 and 66 of FIG. 6. As seen in FIG. 7, the first operation performed (block 72) is to calculate the absolute temperature. This is done in a well-known manner of adding 273 to the pyrometer reading which is normally in degrees Celsius to give the temperature in absolute terms; i.e., ° K. After this computation, the subroutine, through the calculating means or arithmetic unit of the computer 18, using data stored relative to this bar in the store of a computer 18, calculates a radiation coefficient ($R_c$) for the bar. As shown in block 74:

$$R_c = (2eS/pCH) \cdot M.$$

As earlier explained, if this subroutine is being employed for when the bar is on the open portion of the table, that is distances X or Z of FIG. 2, the value of M is 1 (blocks 55 and 65 of FIG. 6). On the other hand, if this subroutine is being employed for that time when the bar is in the coiler, the modifier M will be that as determined in block 58 of FIG. 6.

Leaving block 74 and passing through junction 78, a decision block 80, the first block of an iterative loop is entered. In block 80, it is determined whether the radiation time is greater than the desired time increment as described with respect to FIG. 3. (It will be remembered from the FIG. 3 discussion that because of the nonlinear nature of the term $T_s^4 - T_a^4$, greater accuracy is had by using small time increments.) If the radiation time is greater than the desired increment (10 seconds in the present example), then the YES path is followed to block 84 where the product of $R_c \cdot t$ is calculated using the maximum radiation increment allowed. If not, then the NO path is followed and the term $R_c \cdot t$ is calculated using the actual radiation time remaining.

From block 82 or 84, block 86 is entered in which the radiation rate $R_R$ is calculated. This amounts to taking the difference between the fourth powers of the strip temperature and the ambient temperature. It is to be understood that the first time that this block is entered, $T_s$ is equal to the temperature in ° K as sensed by the pyrometer 16 whereas upon subsequent entries to this block, the value for $T_s$ is the last value of $T_s$ calculated during this subroutine. In block 88, the temperature for this time increment is calculated by multiplying the result of either block 82 or 84 times the results of block 86 to give a total temperature drop TD which drop is then substrated from the then being used $T_s$ in block 90 to give a new strip absolute temperature. In block 92, the remaining time is determined and the results of this determination governs the path to be taken from decision block 94. If the time remaining is greater than zero, then the NO path out of block 94 is taken to junction 78 and another incremental temperature drop calculated and a new temperature strip calculated. If there is no time remaining, then the YES path is taken from the decision block 94 and, as is shown in block 96 the last calculated strip temperature is utilized either as the new $T_s$ for subsequent calculations in the routine of FIG. 6 or as the entry temperature for the bar into the finishing mill.

Thus it is seen that by the present invention there is provided a basic temperature computation routine which, through the development of an appropriate modifier, uses a relatively simple subroutine repeatedly for different phases of the delay table to accurately determine the temperature of a bar entering the second phase of a rolling operation based upon the bar temperature as it left a first rolling phase.

While there has been shown and described what is at present considered to be the preferred embodiment of the present invention, modifications thereof will readily occur to those skilled in the art. For example, in the description and illustration of both the prior art and the present invention, the temperature of the bar exiting the roughing mill was determined by sensing through the use of pyrometers. It is to be understood that other means or methods of determining this temperature could be used with equal facility. An example of such an alternative is described and claimed in U.S. Pat. No. 3,628,358, "Method Of Revising Workpiece Temperature Estimates Or Measurements Using Workpiece Deformation Behavior" By Donald J. Fapiano et al (issued Dec. 21, 1971 and assigned to the assignee of the present invention). This patent teaches how the predicted temperature of a bar exiting a roughing mill may be made more accurate through the use of force measurements occurring during rolling in the roughing mill. It is not desired, therefore, that the invention be limited to the specific embodiment shown and described and it is intended to cover in the appended claims all such modifications as fall within the true spirit and scope of the invention.

What is claimed is:

1. In a continuous hot strip mill system including a first rolling mill, a second rolling mill and an intermediate delay table having an open portion and a coiler portion, means for determining the temperature of a bar being rolled comprising:

a. means to determine the bar temperature as it emerges from the first rolling mill;
b. means to determine the amount of time the bar remains on the open portion of the delay table;
c. means to determine the amount of time the bar remains in said coiler portion; and,
d. computer means including calculating means for calculating the temperature of the bar as it enters the second rolling mill as a function of the determined times and the bar temperature as it exited the first rolling mill.

2. The invention in accordance with claim 1 wherein said computer means further includes a store for retaining values representing physical parameters of the bar and for further retaining a modifier table defining the heat loss relationship between the bar on the open portion of the delay table and in the coiler portion.

3. The invention in accordance with claim 2 wherein said modifier table is defined in terms of time and bar thickness.

4. The invention in accordance with claim 1 wherein the means to determine the times the bar is present on the open and coiler portions of the delay table includes pyrometers for supplying signals to said computing means.

5. The invention in accordance with claim 1 wherein said first rolling mill is a roughing mill and said second rolling mill is a finishing mill.

6. A method of determining the temperature of a metal bar entering the second stage of a continuous hot rolling mill having a first stage and a delay table for delivering the bar from the first to the second stage, said delay table including an open portion and a coiler into which said bar is placed for a period of time as the bar passes from the first stage to the second stage, said method comprising the steps of:

a. determining the temperature of the bar as it exits the first stage of said mill;
b. determining the amount of time the bar is present on the open portion of the delay table;
c. calculating the drop in bar temperature when on the open portion of the delay table;
d. determining the amount of time the bar is present in the coiler portion of the delay table;
e. calculating the drop in bar temperature of the bar when in the coiler; and,
f. subtracting from the determined temperature of the bar as it exited the first stage of the mill the temperature drops while on the open and coiler portions of the delay table to derive a bar temperature for use in determining the temperature of the bar entering the second stage of said mill.

7. The invention in accordance with claim 6 wherein the steps of calculating and subtracting are performed in an electronic computer.

8. The invention in accordance with claim 7 further including the step of storing within a store of said computer, a modifier table defining the heat loss relationship between the bar on the open portion of the delay table and the bar in the coiler.

9. The invention in accordance with claim 8 wherein said modifier table is defined in terms of time and bar thickness.

10. A method of determining the temperature of a metal bar entering a finishing mill of a continuous hot strip mill also having a roughing mill and a delay table including an open portion and a coiler onto which the bar is placed for a period of time as said bar passes from the roughing mill to the finishing mill, said method comprising the steps of:

a. storing, in the store of a computer, parameters relating to the physical properties of the bar being rolled;
b. determining the temperature of the tailing end of the bar as it exits the roughing mill;
c. determining the amount of time the bar is present on the open portion of the delay table;
d. calculating the drop in bar temperature when on the open portion of the delay table as a function of said stored parameters, the bar temperature and the amount of time the bar is on the open portion;
e. determining the amount of time the bar is present in the coiler;
f. calculating the drop in bar temperature when in the coiler as a function of said stored parameters, the bar temperature and the amount of time the bar is in the coiler; and,
g. subtracting from the determined temperature of tailing end of the bar the temperature drops of the bar while on said open portion and in said coiler to thereby establish a final bar temperature to which adjustments may be made due to other mill functions to determine the finish mill entry temperature.

11. The invention in accordance with claim 10 wherein the steps of calculating and subtracting are performed in an electronic computer.

12. The invention in accordance with claim 11 further including the step of storing within a store of said computer, a modifier table defining the heat loss relationship between the bar on the open portion of the delay table and the bar in the coiler.

13. The invention in accordance with claim 12 wherein said modifier table is defined in terms of time and bar thickness.

14. A method of determining the amount of temperature drop of a metal bar due to its presence on a delay intermediate a roughing mill and a finishing mill of a continuous hot strip mill system, and delay table having an open portion and a coiler, the method comprising the steps:

a. storing, in the store of a computer,
   1. parameters relating to the physical properties of the bar being rolled,
   2. a program routine for calculating temperature drop, and
   3. a table of modifiers defining the relative rate of heat loss by the bar between the open portion of the delay table and the coiler;

b. determining the temperature of the tailing end of the bar as it leaves the roughing mill;

c. determining the amount of time the bar is present on the open portion of the delay table;

d. determining the amount of time the bar is present in the coiler;

e. calculating by repeated executions of said program routine, the drops in temperature of said bar while on said open portion and in said coiler as a function of said stored parameters, the bar temperature of the bar leaving the roughing mill, the amounts of time spent on the open portion and in said coiler, and selected modifiers from said stored table; and, f. combining the results of said repeated calculations to determine the total amount of temperature drop of the bar while present on the delay table.

* * * * *